US006342005B1

(12) United States Patent
Daniels et al.

(10) Patent No.: US 6,342,005 B1
(45) Date of Patent: Jan. 29, 2002

(54) ACTIVE NOISE CONTROL FOR PLUG FAN INSTALLATIONS

(75) Inventors: Mark A. Daniels, Manlius; Shau-Tak R. Chou, Fayetteville, both of NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/408,502

(22) Filed: Sep. 30, 1999

(51) Int. Cl.[7] ..... F24F 7/007

(52) U.S. Cl. ..... 454/338; 454/233; 454/DIG. 906; 181/224

(58) Field of Search ..... 454/DIG. 906, 454/232, 233, 236, 338; 181/224, 225; 417/360, 423.15, 313

(56) References Cited

U.S. PATENT DOCUMENTS 4,122,303 A * 10/1978 Chaplin et al. ..... 179/1 P
5,279,515 A * 1/1994 Moore et al. ..... 415/206
5,460,570 A * 10/1995 Okamura et al. ..... 454/68
5,502,869 A * 4/1996 Smith et al. ..... 15/326
5,733,320 A * 3/1998 Augustine ..... 607/107

* cited by examiner

*Primary Examiner*—Harold Joyce
*Assistant Examiner*—Derek S. Boles

(57) ABSTRACT

A plug or plenum fan is located near two walls of the plenum such that they tend to act as the scroll for the fan. Additionally, a partition separates the fan from an adjacent corner further enhancing the formation of a scroll while providing a flow passage and a location for at least a part of the active noise control structure.

13 Claims, 2 Drawing Sheets

ACTIVE NOISE CONTROL FOR PLUG FAN INSTALLATIONS

BACKGROUND OF THE INVENTION

A plug or plenum fan is the term used to describe the application of backward inclined or airfoil fans housed in large plenums. The fan typically consists of a single-inlet impeller assembly with an inlet bell-mouth. The orifice is mounted flush to one side of the plenum, such that the orifice and shaft of the fan are generally in the direction of the flow. Both draw-through and blow-through applications are used. For draw-through applications, the fan and plenum are located downstream of the heating and cooling coils. For the blow-through applications, the fan and coil sections are reversed. In the draw through case, the fan pressurizes the plenum and one or more discharge ducts are attached at any of the side-walls. For most packaged units however, the discharge is attached directly downstream of the fan/plenum section. This section may include passive mufflers, filter sections and additional coils (blow-through). For cases where passive mufflers are supplied, an additional settling section is required which adds to the overall length of the system. An inlet section is attached at the fan/plenum interface; this may also include the same components as those described for the discharge section.

To control the noise from air handling units, duct active noise control (ANC) systems are starting to be employed in air distribution systems. An ANC system basically requires the sensing of the noise associated with the fan for distributing the air, producing a noise canceling signal and determining the results of the canceling signal so as to provide a correction signal to the controller producing the noise canceling signal. There is a time delay associated with sensing the noise and producing a canceling signal. This time delay necessary for the canceling to take place equates to the minimum flow path distance in the system required between the reference, or input, noise sensor and the loudspeaker. Additional space is required between the loudspeaker and the error sensor which adds to the flow path distance in the system. The space limitations in existing buildings severely limits the retrofitting or replacement of existing equipment with equipment using conventional ANC approaches due to the system length requirements. The employing of an active noise control device would eliminate the need for both the downstream settling and passive muffler sections. However, conventional active noise control configurations would also add considerable length to the system, on the order of six to eight feet.

SUMMARY OF THE INVENTION

The fan is asymmetrically located within the plenum with an offset such that the centerline of the fan is biased towards one of the corners of the plenum. This offset places the fan close to two walls of the plenum such that they effectively act like the scroll of a centrifugal fan, diffusing the flow and providing a more efficient operation. By asymmetrically locating the fan, as described, a corner opposite one in which the fan is located can be the location of the outlet with a partition defining a part of the discharge path as well as a part of the effective scroll for the fan. The partition can serve as a location of at least a portion of the active noise control structure thereby minimizing the system length increase due to the active noise control structure.

It is an object of the invention to attenuate noise at the inlet or discharge of a plug fan using active noise control.

It is another object of this invention to provide optimized performance in combination with a small package size.

It is a further object of this invention to locate the discharge duct relative to the fan so as to increase aerodynamic efficiency. These objects, and others as will become apparent hereinafter, are accomplished by the present invention.

Basically, a plug or plenum fan is located near two walls of the plenum such that they tend to act as the scroll for the fan. Additionally, a partition separates the fan from an opposite corner further enhancing the formation of a scroll while providing a flow passage and a location for at least a part of the active noise control structure.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
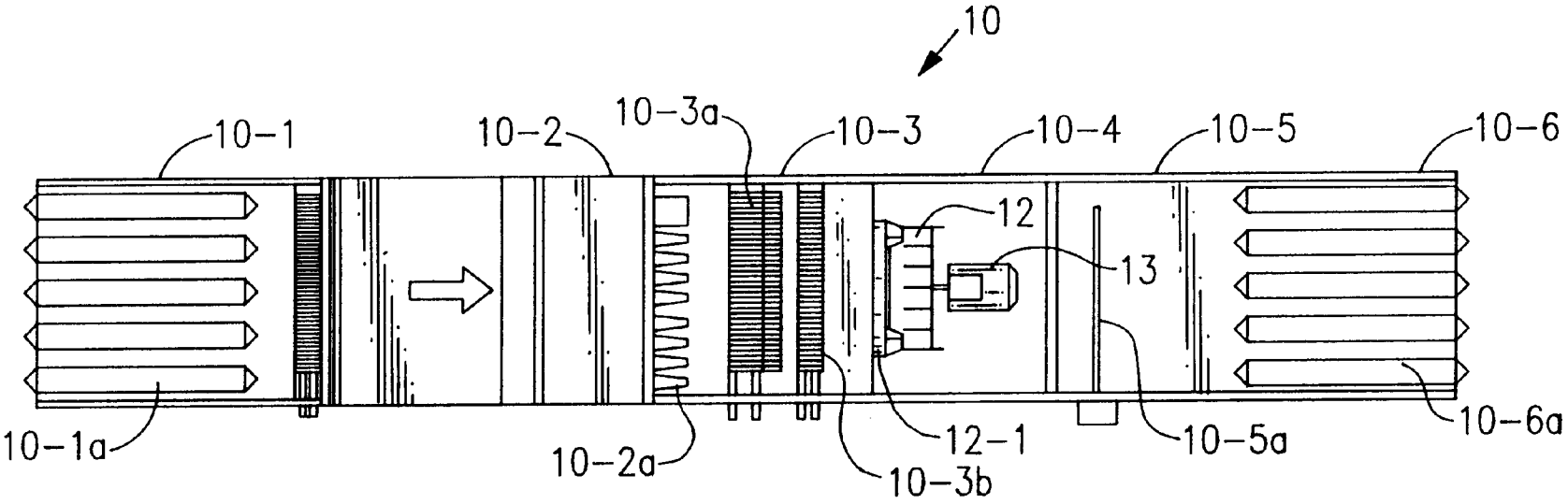
FIG.1 Prior Art
FIG. 1 is a view with the top panels removed of a PRIOR ART air handler unit arrangement employing passive mufflers.

In FIG. 1, the numeral 10 generally designates a conventional air handler unit (AHU) with passive mufflers for sound reduction. The AHU 10 is made up of a plurality of sections and/or subassemblies including settling section 10-1 containing passive mufflers 10-1*a,* filter section 10-2 containing filter 10-2*a,* coil section 10-3 containing coils 10-3*a* and 10-3*b,* fan section 10-4 containing backward inclined or airfoil fan 12 and, settling section 10-5 having a baffle 10-5*a* and muffler section 10-6 containing passive mufflers 10-6*a*. Fan 12 is driven by motor 13 and has an inlet orifice 12-1 aligned with the overall flow path through AHU 10. Fan 12 discharges transversely to the overall flow path.

In operation, fan or blower 12 is driven by motor 13 thereby drawing return and makeup air into the AHU 10, through a heat exchanger defined by coils 10-3*a* and 10-3*b* to heat or cool the air, thence via inlet orifice 12-1 into fan 12 which discharges the air into fan housing 10-4. Baffle 10-5*a* provides a circuitous discharge path from fan housing 10-4 to settling section 10-5. The flow from settling section 10-5 travels through muffler section 10-6 which contains passive mufflers 10-6*a* and thence into the air distribution system (not illustrated).

Figure 2:
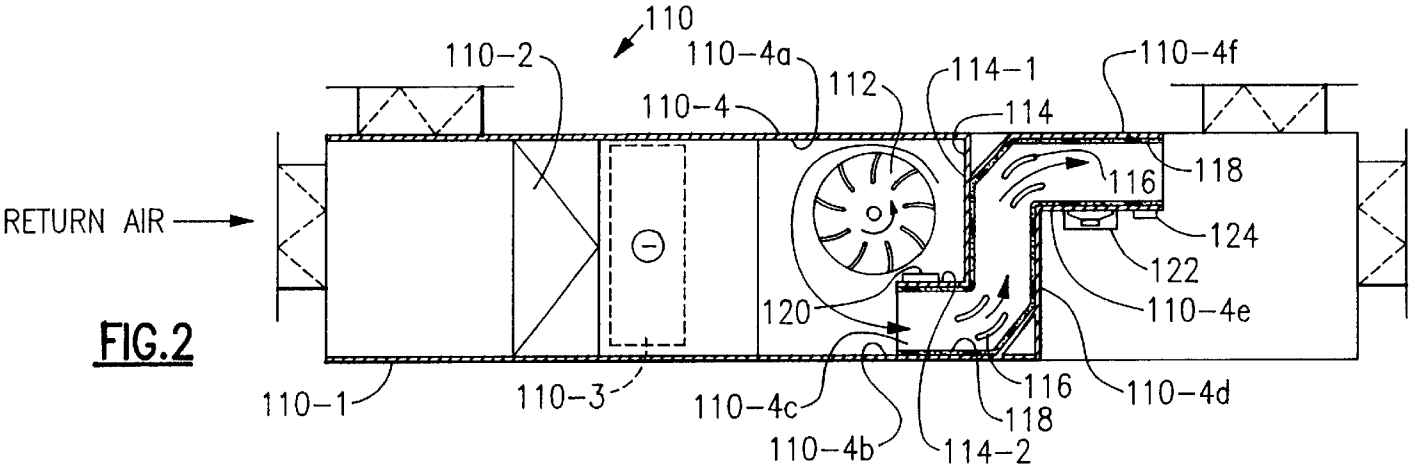
FIG. 2 is a view with the side panel removed of an air handler unit arrangement employing the present invention.

Referring now to FIG. 2, AHU 110 has a mixing box 110-1, filter 110-2, coil 110-3 and fan housing 110-4. A baffle 114 extends from one of the walls of fan housing 110-4 and is made up of two legs 114-1 and 114-2. Backward inclined or airfoil fan 112 is located in fan housing 110-4 transversely to the overall flow path through AHU 110 and is located in proximity to wall 110-4*a* and legs 114-1 and 114-2 of baffle 114 which coact to effectively define a scroll for fan 112. Additionally, leg 114-2 coacts with a portion of walls 110-4*b* and 110-4*c* and a wall (not illustrated) to define a first portion of the outlet flow path from fan housing 110-4. The outlet flow path is defined by walls 110-4*b*, 110-4*c*, 110-4*d*, 110-4*e*, and 110-4*f*, a wall (not illustrated) as well as legs

114-1 and 114-2 such that it, effectively has three sections at 90° angles. The center of the fan housing 110-4 is offset from the center AHU110 so as to allow the fan 112 to circulate the incoming air downwardly toward the aforementioned outlet flowpath as shown. The outlet flow path containing the ANC system is sized to keep the flow under 2,500 feet per minute to obtain optimum system performance. Guide vanes 116 are located at the 90° bends to guide the flow. Acoustic lining 118 is located on the structure defining the outlet flow path. The circuitous discharge flow path adds flow path length while adding less length than that required by settling section 10-5 and muffler section 10-6 of AHU 10. The length reduction achieved through the use of the present invention is roughly the length required by settling section 10-5 of AHU 10. Duct active noise control (ANC) is located relative to the discharge flow path. The locating of ANC structure in the flow path depends upon locating the sensing microphone (s) 120 at or near the blower outlet/inlet to the discharge flow path where noises due to turbulence normally preclude the placement of the sensing microphone(s) 120. The placement of sensing microphone(s) 120 in the region of the blower outlet is possible through the use of turbulence shields which are the subject of commonly assigned U.S. Pat. No. 5,808,243 and U.S. patent application Ser. No. 08/871,202 filed Jun. 27, 1997. Additionally, commonly assigned U.S. patent application Ser. No. 08/884,231 filed Jun. 27, 1997 discloses the locating of ANC structure in an elbow. The noise canceling speaker(s) 122 and the error sensing microphone (s) 124 are located in the discharge flow path downstream of sensing microphone(s) 120 and, preferably, downstream of guide vanes 116.

In operation, fan 112 is driven by a motor (not illustrated) thereby drawing return air and makeup air into the AHU 110, through the heat exchanger defined by coil 110-3 to heat or cool the air and delivering the resultant conditioned air into fan housing 110-4 where it passes into the discharge flow path defined in part by leg 114-2 and walls 110-4*b* and 110-4*c*. The fan noise in the discharge flow path is sensed by microphone(s) 120 and through circuitry (not illustrated) speaker(s) 122 which is located on wall 110-4*e* is driven to produce a signal to cancel the fan noise. Microphone(s) 124 which is located on wall 110-4*e* senses the result of the noise cancellation by speaker(s) 122 and through circuitry (not illustrated) the output of speaker(s) 122 is corrected. Accordingly, the ANC system is kept wholly within the casing structure of AHU 110.

Figure 4:
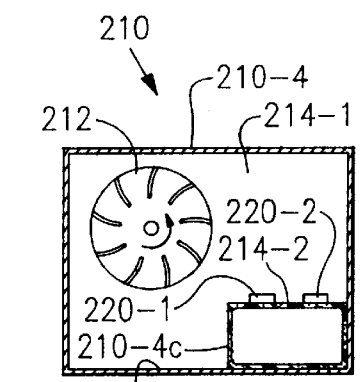
FIG. 4 is a sectional view taken along line 4—4 of FIG. 3.
Figure 3:
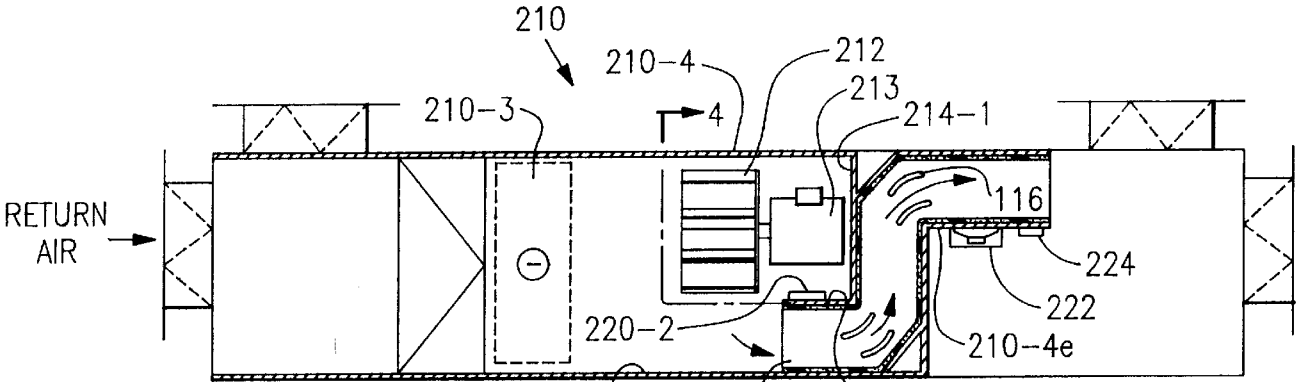
FIG. 3 is a view with the side panel removed of a modified air handler unit arrangement employing the present invention.

FIGS. 3 and 4 illustrate a modified embodiment of the invention. AHU 210 differs from AHU 110 in that backward inclined or airfoil fan 212 is rotated 90° such that its axis of rotation is generally aligned with the overall flow path through AHU 210. The structure and operation would otherwise be the same as that of AHU 110. Specifically, fan 212 is driven by motor 213 thereby drawing return air and makeup air into AHU 210, through the heat exchanger defined by coil 210-3 to heat or cool the air and delivering the resultant conditioned air into fan housing 210-4 where it passes into the discharge flow path defined in part by legs 214-1 and 214-2 and walls 210-4*b* and 210-4*c*. The fan noise in the discharge flow path is sensed by microphones 220-1 and 220-2 and through circuitry (not illustrated) speaker(s) 222 which is located on wall 210-4*e* is driven to produce a signal to cancel the fan noise. Microphone(s) 224 which is located on wall 201-4*e* senses the result of the noise cancellation by speaker(s) 222 and through circuitry (not illustrated) the output of speaker(s) 222 is corrected.

From the foregoing description, it should be clear that the noise canceling structure is incorporated into the fan housing 110-4 or 210-4 and eliminates the need for the settling section 10-5 of AHU 10.

Although preferred embodiments of the present invention have been illustrated and described, other changes will occur to those skilled in the art. For example, the description has been specific to draw-through applications but could be applied to blow-through applications by reversing the fan and coil sections. It is therefore intended that that scope of the present invention is to be limited only by the scope of the appended claims.

What is claimed is:

1. Active noise control for plug fan installation comprising:

an air handling unit having an incoming air flow path to a fan housing defined by a plurality of walls;

an airfoil fan located in said fan housing and having an axis of rotation which is transverse to the incoming air flow path, said air foil fan furthermore located in said fan housing such that two adjacent ones of said plurality of walls coact with said fan so as to act as a fan scroll;

a discharge flow path extending from said fan housing so as to direct air from said air handling unit to an air distribution system;

duct active noise control means for sensing and canceling air flow noises in said discharge flow path.

2. The active noise control of claim 1 wherein said means includes a noise sensor and a noise canceller serially located along said discharge flow path.

3. The active noise control of claim 2 wherein said means further includes an error sensor.

4. The active noise control of claim 1 wherein said fan has an axis of rotation which is transverse to said discharge flow path.

5. The active noise control of claim 4 wherein said means includes a noise sensor and a noise canceller serially located along said discharge flow path.

6. The active noise control of claim 5 wherein said means further includes an error sensor.

7. The active noise control of claim 1 wherein two of said plurality of walls define a baffle within the air handling unit, said baffle being transverse to the incoming air flow path.

8. The active noise control of claim 7 wherein the center of said air foil fan is offset from the center of the incoming air flow path in said air handling unit.

9. The active noise control of claim 7 wherein said discharge flow path is defined by one of the plurality of walls that define the baffle within the air handling unit.

10.The active noise control of claim 9 wherein the discharge flow path defined by one of the plurality of walls that define the baffle is below fan housing.

11. The active noise control of claim 1 further comprising discharge flow path structure having at least two angled bends therein so as to change the direction of discharged air from said air foil fan twice and wherein said duct active noise control is located on the discharge flow path structure downstream of said second bend in the discharge flow path structure whereby the length of discharge flow path structure between said air foil fan and said duct active noise control means is sufficient to cancel the air flow noise from said air foil fan.

12. The active noise control of claim 11 wherein said two angled bends are each ninety degree angled bends.

13. The active noise control of claim 11 further comprising a heat exchange coil located in said air handling unit upstream of said air foil, the air flow through said heat exchange coil not changing direction as it becomes incoming air flow to said air foil fan.

* * * * *